US012442097B2

(12) United States Patent
Wadhavkar et al.

(10) Patent No.: US 12,442,097 B2
(45) **Date of Patent: *Oct. 14, 2025**

(54) ELECTROFORMING SYSTEM AND METHOD

(71) Applicant: Unison Industries, LLC, Jacksonville, FL (US)

(72) Inventors: Ashwini Sameer Wadhavkar, Bengaluru (IN); Dattu Guru Venkata Jonnalagadda, Bengaluru (IN); Rajapriyan Rajendran, Bengaluru (IN); Gordon C. Tajiri, Waynesville, OH (US); Udaya Bhaskar Pamidimarri, Bengaluru (IN)

(73) Assignee: Unison Industries, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/498,245

(22) Filed: Oct. 31, 2023

(65) Prior Publication Data

US 2024/0060200 A1 Feb. 22, 2024

Related U.S. Application Data

(63) Continuation of application No. 17/558,160, filed on Dec. 21, 2021, now Pat. No. 11,898,260.

(30) Foreign Application Priority Data

Aug. 23, 2021 (IN) ..... 202111038059

(51) Int. Cl.

| | |
|---|---|
| ***C25D 1/10*** | (2006.01) |
| ***C25D 17/06*** | (2006.01) |
| ***C25D 17/12*** | (2006.01) |

(52) U.S. Cl.

CPC ..... *C25D 1/10* (2013.01); *C25D 17/06* (2013.01); *C25D 17/12* (2013.01)

(58) Field of Classification Search

None

See application file for complete search history.

(56) References Cited

U.S. PATENT DOCUMENTS

| | | | |
|---|---|---|---|
| 1,845,052 | A | 2/1932 | Laukel |
| 3,498,890 | A | 3/1970 | Divecha et al. |
| 3,582,523 | A | 6/1971 | Linnhoff |
| 3,617,449 | A | 11/1971 | Giles et al. |

(Continued)

FOREIGN PATENT DOCUMENTS

| | | | |
|---|---|---|---|
| CN | 1418265 | A | 5/2003 |
| CN | 104024490 | A | 9/2014 |

(Continued)

OTHER PUBLICATIONS

English translation JPH10195696 (Year: 1998).*

*Primary Examiner* — Stefanie S Wittenberg

(74) *Attorney, Agent, or Firm* — McGarry Bair PC

(57) ABSTRACT

An electroforming system and method for electroforming a component that includes a first housing and a second housing, where the second housing can define a conformable electroforming reservoir with a base structure. An electrically insulating sheet covers at least a portion of the base structure and defines a fluid passage where the component is to be located.

16 Claims, 9 Drawing Sheets

(56) References Cited

U.S. PATENT DOCUMENTS

| | | | | |
|---|---|---|---|---|
| 3,852,170 | A * | 12/1974 | Angelini | C25D 7/04 204/207 |
| 3,929,592 | A | 12/1975 | Klingenmaier | |
| 4,304,641 | A | 12/1981 | Grandia et al. | |
| 4,359,375 | A | 11/1982 | Smith | |
| 4,434,039 | A | 2/1984 | Baboian et al. | |
| 4,441,976 | A | 4/1984 | Iemmi et al. | |
| 4,529,486 | A | 7/1985 | Polan | |
| 4,534,831 | A | 8/1985 | Inoue | |
| 4,853,099 | A | 8/1989 | Smith | |
| 4,933,061 | A | 6/1990 | Kulkarni et al. | |
| 5,360,525 | A * | 11/1994 | Dyke | C25D 1/04 204/216 |
| 5,421,987 | A | 6/1995 | Tzanavaras et al. | |
| 5,516,412 | A | 5/1996 | Andricacos et al. | |
| 5,562,810 | A | 10/1996 | Urquhart | |
| 5,597,460 | A | 1/1997 | Reynolds | |
| 5,837,120 | A | 11/1998 | Forand et al. | |
| 5,932,077 | A | 8/1999 | Reynolds | |
| 5,958,604 | A | 9/1999 | Riabkov et al. | |
| 5,976,340 | A | 11/1999 | Sheldon et al. | |
| 6,004,447 | A | 12/1999 | Bischoping et al. | |
| 6,099,702 | A | 8/2000 | Reid et al. | |
| 6,126,798 | A | 10/2000 | Reid et al. | |
| 6,136,163 | A | 10/2000 | Cheung et al. | |
| 6,287,444 | B1 * | 9/2001 | Nishiuchi | C25D 17/16 205/128 |
| 6,348,138 | B1 | 2/2002 | Yoshimura et al. | |
| 6,379,511 | B1 | 4/2002 | Fatula et al. | |
| 6,551,472 | B2 | 4/2003 | Saito et al. | |
| 6,761,807 | B2 | 7/2004 | Velez, Jr. et al. | |
| 6,821,407 | B1 | 11/2004 | Reid et al. | |
| 6,899,803 | B2 | 5/2005 | Matejat | |
| 7,112,268 | B2 | 9/2006 | Okase et al. | |
| 7,264,704 | B2 | 9/2007 | Nevosi et al. | |
| 7,279,079 | B2 | 10/2007 | Mizohata et al. | |
| 7,837,843 | B2 | 11/2010 | Sharp et al. | |
| 7,931,786 | B2 | 4/2011 | Wilson et al. | |
| 7,998,323 | B1 | 8/2011 | Chandra et al. | |
| 8,262,871 | B1 | 9/2012 | Mayer et al. | |
| 8,980,067 | B2 | 3/2015 | Secherling et al. | |
| 9,249,521 | B2 | 2/2016 | Tomantschger et al. | |
| 9,752,249 | B2 | 9/2017 | Hiraoka et al. | |
| 9,816,194 | B2 | 11/2017 | He et al. | |
| 9,970,120 | B2 | 5/2018 | Tomantschger et al. | |
| 10,781,524 | B2 | 9/2020 | Whitaker et al. | |
| 2004/0016637 | A1 | 1/2004 | Yang et al. | |
| 2004/0134775 | A1 | 7/2004 | Yang et al. | |
| 2005/0109612 | A1 | 5/2005 | Woodruff et al. | |
| 2006/0131177 | A1 | 6/2006 | Bogart et al. | |
| 2009/0277794 | A1 | 11/2009 | Trice et al. | |
| 2010/0032303 | A1 | 2/2010 | Reid et al. | |
| 2010/0147679 | A1 | 6/2010 | Feng et al. | |
| 2010/0170801 | A1 | 7/2010 | Metzger | |
| 2014/0158545 | A1 * | 6/2014 | Schafer | C25D 17/12 204/251 |
| 2015/0129418 | A1 | 5/2015 | Keigler et al. | |
| 2019/0112728 | A1 | 4/2019 | Hosokawa | |
| 2020/0131653 | A1 | 4/2020 | Jonnalagadda et al. | |
| 2020/0131663 | A1 | 4/2020 | Jonnalagadda et al. | |

FOREIGN PATENT DOCUMENTS

| | | | |
|---|---|---|---|
| CN | 106796963 | A | 5/2017 |
| GB | 2103248 | A1 | 2/1983 |
| SG | 91119 | A1 | 9/2002 |
| WO | 9836107 | A1 | 8/1998 |

* cited by examiner

ELECTROFORMING SYSTEM AND METHOD

CROSS-REFERENCE TO RELATED APPLICATION

This application is a continuation of U.S. patent application Ser. No. 17/558,160, filed Dec. 21, 2021, now U.S. Pat. No. 11,898,260, issued Feb. 13, 2024, which claims priority to Indian Provisional Application No. 202111038059, filed Aug. 23, 2021, which are incorporated herein by reference in their entirety.

TECHNICAL FIELD

The disclosure relates to an electroforming reservoir and system and method for electroforming.

BACKGROUND

An electroforming process can create, generate, or otherwise form a metallic layer on a component or mandrel. In one example of the electroforming process, a mold or base for the desired component can be submerged in an electrolytic liquid and electrically charged. The electric charge of the mold or base can attract an oppositely-charged electroforming material through the electrolytic solution or electrolytic fluid. The attraction of the electroforming material to the mold or base ultimately deposits the electroforming material on the exposed surfaces of the mold or base, creating an external metallic layer.

BRIEF DESCRIPTION OF THE DRAWINGS

A full and enabling disclosure of the aspects of the present description, including the best mode thereof, directed to one of ordinary skill in the art, is set forth in the specification, which refers to the appended Figs., in which.

DETAILED DESCRIPTION

Figure 1:
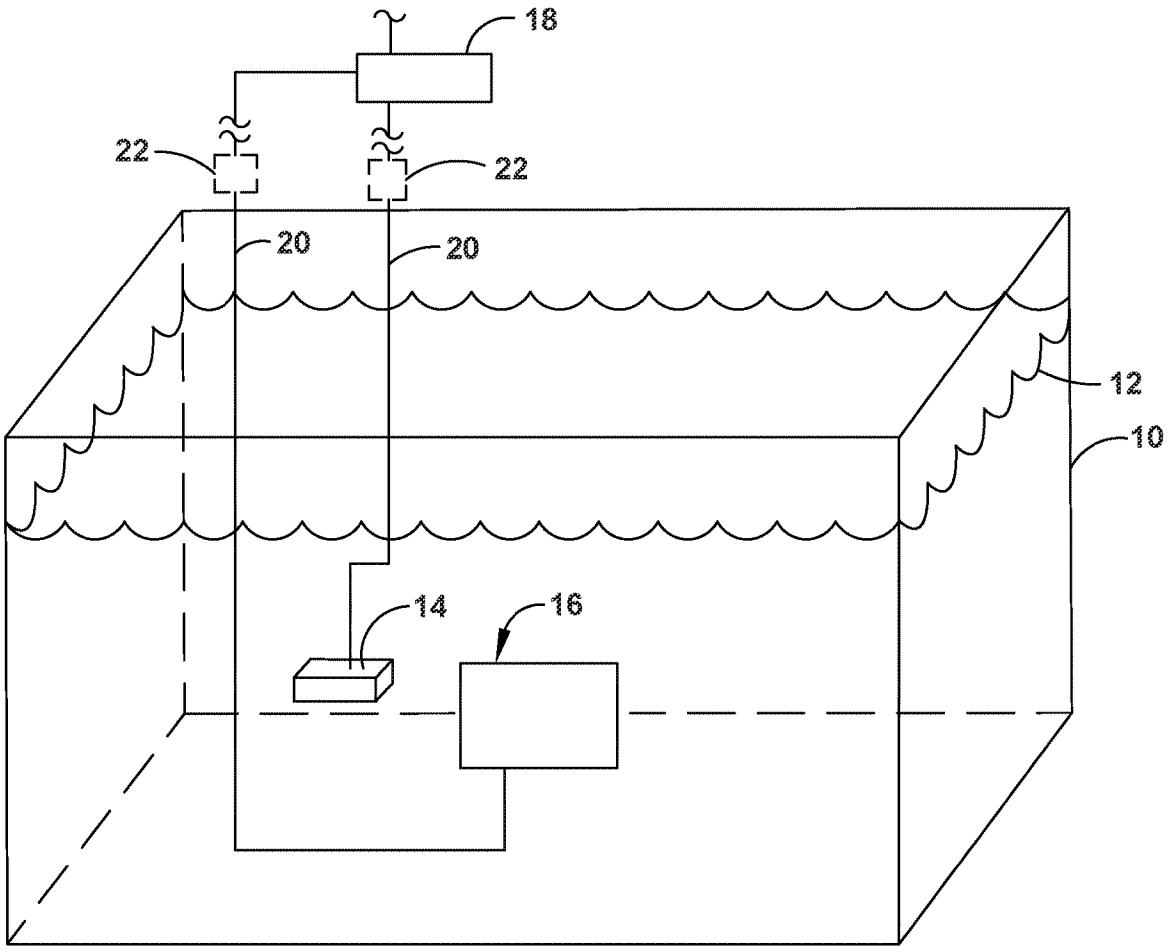
FIG. 1 (PRIOR ART)
FIG. 1 is a schematic view of a prior art electroforming bath for forming a component.

In the conventional electroforming process, the component or workpiece is placed in electrolytic solution or electrolyte fluid. This results in the anode and the component or the cathode being housed in the same reservoir. Controlling variation of thickness and material composition in the conventional electroforming environment is challenging if not impossible.

Aspects of the present disclosure are directed to a system and method for electroforming a component. The system and method for electroforming a component include a first housing for the dissolution reservoir and anode connection. A second housing, separate from the first housing, contains the component coupled to the cathode. A recirculation system circulates the electrolyte fluid back and forth between the first housing and the second housing. The second housing can define an electroforming reservoir that conforms to the component. The geometry of the second housing, the recirculation system, and the connection of a portion of the frame of the second housing to one or more anodes allows control of the thickness and material composition.

It will be understood that the disclosure can have general applicability in a variety of applications, including that the electroformed component can be utilized in any suitable mobile and/or non-mobile industrial, commercial, and/or residential applications.

As used herein, an element described as "conformable" will refer to that element having the ability to be positioned or formed with varying geometric profiles that match or otherwise are similar or conform to another piece. In addition, as used herein, "non-sacrificial anode" will refer to an inert or insoluble anode that does not dissolve in electrolytic fluid when supplied with current from a power source, while "sacrificial anode" will refer to an active or soluble anode that can dissolve in electrolytic fluid when supplied with current from a power source. Non-limiting examples of non-sacrificial anode materials can include titanium, gold, silver, platinum, and rhodium. Non-limiting examples of sacrificial anode materials can include nickel, cobalt, copper, iron, tungsten, zinc, and lead. It will be understood that various alloys of the metals listed above may be utilized as sacrificial or non-sacrificial anodes.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

Additionally, as used herein, the terms "radial" or "radially" refer to a direction away from a common center. For example, in the overall context of a turbine engine, radial refers to a direction along a ray extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, secured, fastened, connected, and joined) are to be construed broadly and can include intermediate members between a collection of elements and relative movement between elements unless otherwise indicated. As such, connection references do not necessarily infer that two elements are directly connected and in fixed relation to one another.

Additionally, as used herein, a "controller" or "controller module" can include a component configured or adapted to provide instruction, control, operation, or any form of communication for operable components to effect the operation thereof. A controller or controller module can include any known processor, microcontroller, or logic device, including, but not limited to: field programmable gate arrays (FPGA), an application specific integrated circuit (ASIC), a full authority digital engine control (FADEC), a proportional controller (P), a proportional integral controller (PI), a proportional derivative controller (PD), a proportional integral derivative controller (PID controller), a hardware-accelerated logic controller (e.g. for encoding, decoding, transcoding, etc.), the like, or a combination thereof. Non-limiting examples of a controller module can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based on one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types. In another non-limiting example, a controller module can also include a data storage component accessible by the processor, including memory, whether transient, volatile or non-transient, or non-volatile memory. Additional non-limiting examples of the memory can include Random Access Memory (RAM), Read-Only Memory (ROM), flash memory, or one or more different types of portable electronic memory, such as discs, DVDs, CD-ROMs, flash drives, universal serial bus (USB) drives, the like, or any suitable combination of these types of memory. In one example, the program code can be stored within the memory in a machine-readable format accessible by the processor. Additionally, the memory can store various data, data types, sensed or measured data values, inputs, generated or processed data, or the like, accessible by the processor in providing instruction, control, or operation to effect a functional or operable outcome, as described herein.

Additionally, as used herein, elements being "electrically connected," "electrically coupled," or "in signal communication" can include an electric transmission or signal being sent, received, or communicated to or from such connected or coupled elements. Furthermore, such electrical connections or couplings can include a wired or wireless connection, or a combination thereof.

Additionally, as used herein, the terms "excitation," "energize," "actuate," or "activate" and their various noun/verb forms can essentially be interchanged and are intended to indicate the control or influence of a regulator or valve. The "excitation," "energization," "actuation," or "activation" regulator or valve can correspond to a change in the output of that device, whether that be of a bi-state or a proportional nature to the control or influence provided. The use of such terms will be readily understood to be used in a non-limiting manner by anyone knowledgeable in the art which constitutes the scope of this document The exemplary drawings are for purposes of illustration only and the dimensions, positions, order and relative sizes reflected in the drawings attached hereto can vary.

A prior art electroforming process is illustrated by way of an electrodeposition bath in FIG. 1. As used herein, "electroforming" or "electrodeposition" can include any process for building, forming, growing, or otherwise creating a metal layer over another substrate or base. Non-limiting examples of electrodeposition can include electroforming, electroless forming, electroplating, or a combination thereof. While the remainder of the disclosure is directed to electroforming, any and all electrodeposition processes are equally applicable.

A prior art bath tank 10 carries a single metal constituent solution 12 having alloying metal ions. A soluble anode 14 spaced from a cathode 16 is provided in the bath tank 10. A component to be electroformed can form the cathode 16.

A controller 18, which can include a power supply, can electrically couple to the soluble anode 14 and the cathode 16 by electrical connection 20 to form a circuit via the conductive single metal constituent solution 12. Optionally, a switch 22 or sub-controller can be included along the electrical connection 20 between the controller 18, soluble anode 14, and cathode 16.

During operation, a current can be supplied from the soluble anode 14 to the cathode 16 to electroform a body at the cathode 16. Supply of the current can cause metal ions from the single metal constituent solution 12 to form a metallic layer over the component at the cathode 16.

In a conventional electroplating process, the soluble anode 14, when it dissolves, results in the conductive single metal constituent solution 12 which is attracted to the body at the cathode 16 to electroplate the body. As the soluble anode 14 dissolves, it also changes shape. Changes in the shape of the soluble anode 14 changes the potential difference between the cathode 16 and soluble anode 14. Variations in the potential difference can result in variations in the thickness of the deposited layer resulting in non-uniform thickness.

Additionally, when the soluble anodes 14 dissolves, additional particulates are released to the conductive single metal constituent solution 12. These additional particulates can couple to the body at the cathode 16, resulting in non-uniform deposition. While not specifically illustrated, the prior art bath tank 1 can include the conventional technique of reducing additional particulates from the soluble anode 14 by containing the soluble anode 14 in a porous anode bag. Even though the anode bag prevents large size particulates being released into the conductive single metal constituent solution 12, it fails to prevent smaller sized particulates from entering the conductive single metal constituent solution 12. This results in a non-uniform deposition. Aspects of the present disclosure relate to a conformable non-sacrificial anode system where the dissolution and the electroforming or electroplating processes occur in separate tanks. This minimizes any additional particles from the dissolution process from reaching the electroforming reservoir. Aspects of the present disclosure also provide more control over the electroforming process to provide the desired thickness of metal layer added to one or more portions of the body or component.

Figure 2:
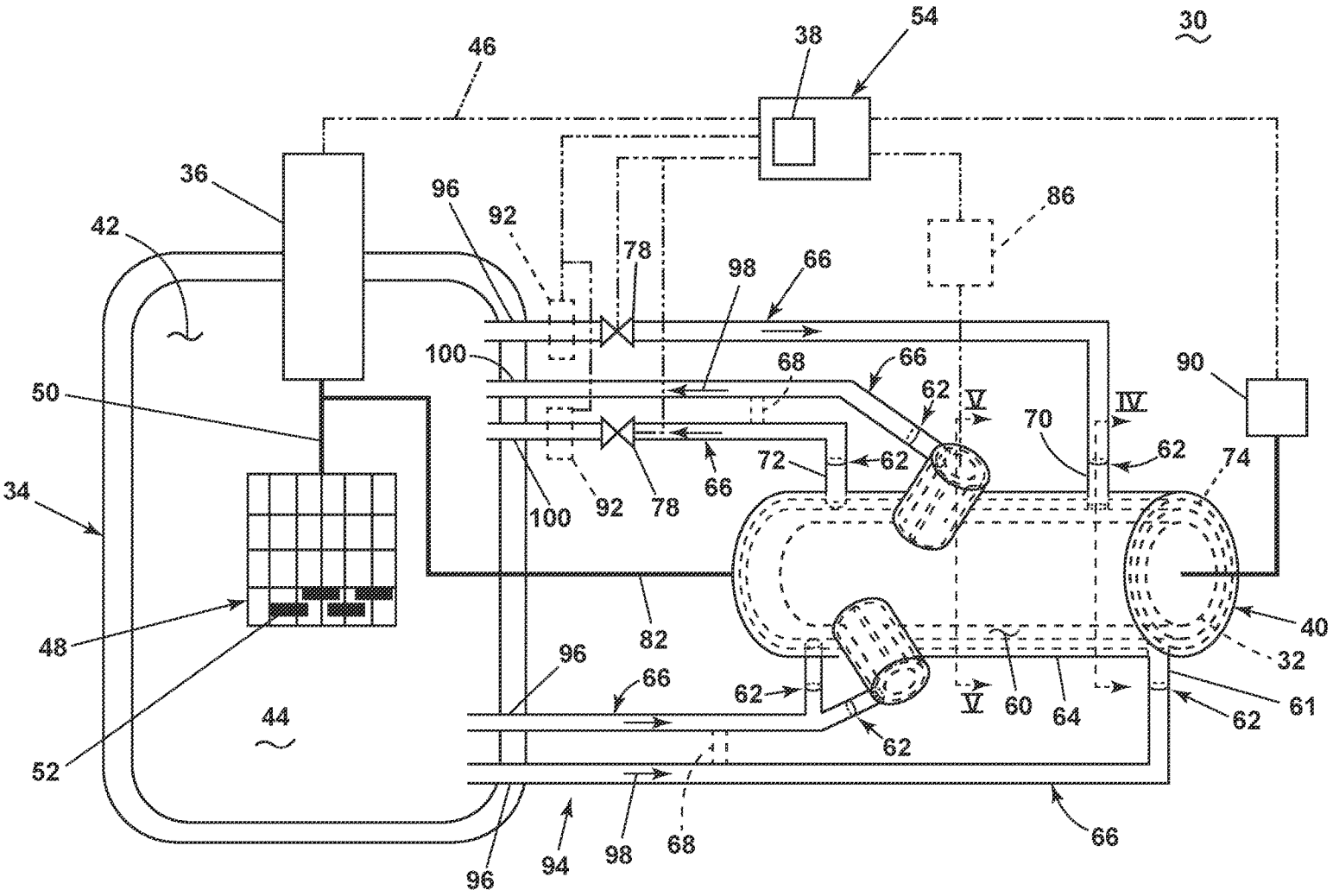
FIG. 2 is a schematic view of a system for electroforming a component according to various aspects of the disclosure.

FIG. 2 illustrates a system 30 for electroforming a workpiece or component 32 in accordance with various aspects of the present disclosure as described herein. The system 30 includes a first housing 34, a first anode 36, a power source 38, and a second housing 40. A dissolution reservoir 42 can be defined by the first housing 34. The dissolution reservoir 42 can contain electrolytic solution or electrolyte fluid 44. In a non-limiting example, the electrolytic fluid 44 can include nickel sulfamate, however, any suitable electrolytic fluid 44 can be utilized.

The first anode 36 can be coupled to or at least partially located within the first housing 34. By way of example, the first anode 36 is located within the dissolution reservoir 42, submerged in the electrolytic fluid 44, and is electrically coupled to the power source 38 by way of electrical connection 46. A titanium basket 48 is coupled to the first anode 36 by a first anode connection 50. It is contemplated that the first anode 36 is a non-sacrificial anode. Alternatively, the first anode 36 can be a sacrificial anode.

Nickel and cobalt pieces in the form of coins 52 can be placed within the titanium basket 48. Optionally, a mesh bag (not shown) can contain the coins 52 within the titanium basket 48 and provide for containment of the coins 52.

A controller 54 can include the power source 38. Alternately, the controller 54 can be separate from the power source 38. The controller 54 can control the flow of current from the power source 38 to the first anode 36 through the electrical connection 46. While illustrated as having the power source 38 and the controller 54, the system 30 can include any number of control modules or power supplies. It is contemplated that the electrical connection 46, the first anode connection 50, or any other component of the system 30 can include or be coupled to any number of switches, sheaths, or known electrical components or communications devices.

An electroforming reservoir 60 can be defined by the second housing 40. The component 32 can be located in the electroforming reservoir 60, such that the component 32 or at the least a portion of the component 32 can be contained within the second housing 40. It is contemplated that the electroforming reservoir 60 can be a conforming electroforming reservoir 60 that has a similar shape, or conforms, to the component 32. While the component 32 is illustrated as a combination of cylinders and the second housing 40 illustrated as a complimentary or conforming combination of cylinders, the component can be any suitable shape, profile, passages, protrusions, or recesses, while the second housing 40 can have any suitable complimentary or conforming shape, profile, passages, protrusions, or recesses.

A set of apertures 62 extend radially outward through a cover 64 of the second housing 40. The cover 64 of the second housing 40 can be an electrically insulating sheet, such as, but not limited to, a polyethene or polypropylene sheet. The set of apertures 62 can include a connecting portion or conduit 63. Optionally, the conduit 63 can extend from or couple to a frame 74, wherein the frame 74 can be contained within the cover 64.

The set of apertures 62 fluidly couple the electroforming reservoir 60 and the dissolution reservoir 42. The fluid connection between the dissolution reservoir 42 and the second housing 40 can include multiple flow paths 66. Optionally, one or more of the multiple flow paths 66 can be coupled with a connecting channel 68. It is contemplated that the multiple flow paths 66 can include any number of conduit sections, junctions, or elements known to maintain fluid flow.

The set of apertures 62 can include at least one inlet aperture 70 and at least one outlet aperture 72, where the at least one inlet aperture 70 receives electrolytic fluid 44 from the dissolution reservoir 42. The at least one outlet aperture 72 allows electrolytic fluid 44 in the electroforming reservoir 60 to flow from the electroforming reservoir 60 to the dissolution reservoir 42.

Optionally, one or more of the set of apertures 62 can couple to any number of dissolution reservoirs to provide the electroforming reservoir 60 with different electrolytic fluid including different densities of a same electrolytic fluid.

A nozzle or valve 78 can be fluidly coupled or coupled to the at least one inlet aperture 70 to control flow of electrolytic fluid 44 to different portions of the second housing 40. While illustrated as upstream of the at least one inlet aperture 70, it is contemplated that the nozzle or valve 78 can be included in, formed with, or directly coupled to one or more portions of the at least one inlet aperture 70. It is further contemplated that the at least one outlet aperture 72 can additionally, or alternatively, include a nozzle or valve 78. The nozzle or valve 78 can be electrically connected to the controller 54, where the controller 54 can control the flow of electrolytic fluid 44 via the nozzle or valve 78.

It is contemplated that controlled variation of the thickness of the metal deposition can be achieved by providing variable concentrations of electrolyte fluid to the electroforming reservoir 60 using the nozzle or valve 78 at the at least one inlet aperture 70.

One or more portions of the second housing 40 can be in communication with the first anode 36 via a second anode connection 82. Additionally, or alternatively, one or more portions of the second housing 40 can be in communication with an auxiliary or second anode 86. The second anode 86 can be electrically coupled to the power source 38 or can be coupled to an additional power supply (not shown). While illustrated as the first anode 36 and the second anode 86, any number of anodes can be coupled to the second housing 40.

A cathode 90 can be coupled to or otherwise in communication with the component 32. The cathode 90 can be electrically coupled to the power source 38 or can be coupled to an additional power supply (not shown).

Auxiliary components 92 can be coupled to one or more of the multiple flow paths 66 or one or more of the set of apertures 62. The auxiliary components 92 can be in communication with the controller 54. By way of non-limiting example, the auxiliary components 92 can be any one or more of a pump, a switch, a fluid flow sensor, a temperature sensor, a mass density sensor, a viscosity sensor, an optical sensor, or a level sensor. While illustrated as coupling to a conduit of the multiple flow paths 66, it is considered that the auxiliary component 92 can be located at or in any portion of the system 30.

A recirculation circuit 94 can be defined between the dissolution reservoir 42 and the electroforming reservoir 60. The recirculation circuit 94 includes the flow of electrolytic fluid 44 from the dissolution reservoir 42 through one or more of the outlets 96 and into the electroforming reservoir 60 via the at least one inlet aperture 70; illustrated with flow arrows 98. The recirculation circuit 94 further includes the flow of fluid from the electroforming reservoir 60 through the at least one outlet aperture 72 and into the dissolution reservoir 42 via at least one inlet 100, as illustrated by the flow arrows 98. In this manner, electrolytic fluid 44 can be supplied from the dissolution reservoir 42 to the electroforming reservoir 60. That is, the electrolytic fluid 44 can be continuously supplied from the dissolution reservoir 42. This can include electrolytic fluid 44 being supplied in discrete portions at regular or irregular time intervals as desired. For example, the nozzle or valve 78 or auxiliary component 92 can be instructed by the controller 54 to supply a predetermined volume of electrolytic fluid to the electroforming reservoir 60 at predetermined time intervals.

Figure 3:
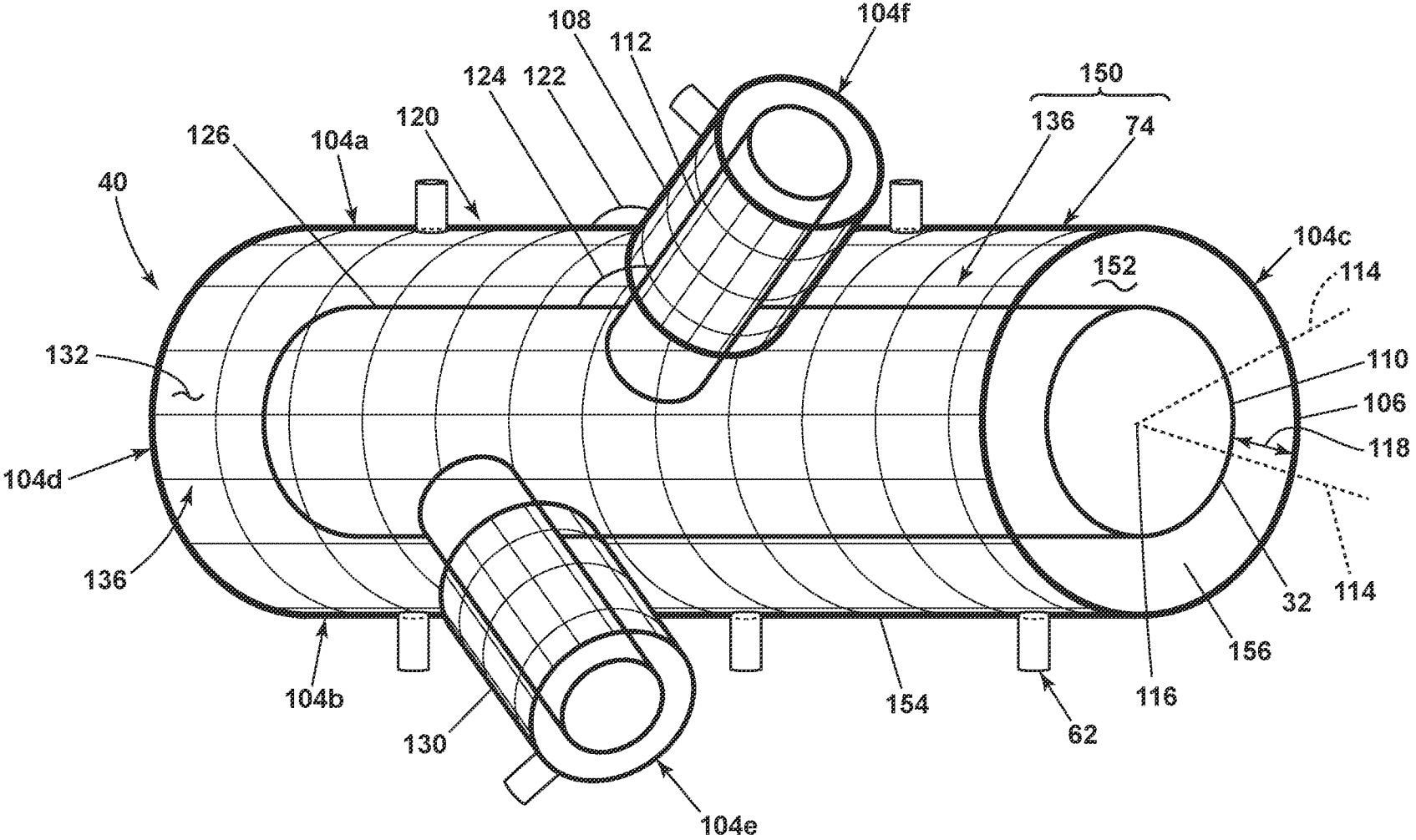
FIG. 3 is a perspective view of a second housing defining an electroforming reservoir that can be utilized in the system of FIG. 2.

FIG. 3 illustrates an example of the second housing 40 in further detail, wherein the cover 64 is removed. The second housing 40 includes the frame 74, where at least one of the set of apertures 62 is provided, mounted, or formed with a portion of the frame 74. The frame 74 can be constructed or defined by a plurality of frame segments 104*a*, 104*b*, 104*c*, 104*d*, 104*e*, 104*f*. That is, the coupling together of the plurality of frame segments 104*a*, 104*b*, 104*c*, 104*d*, 104*e*, 104*f* can define the frame 74. While the plurality of frame segments 104*a*, 104*b*, 104*c*, 104*d*, 104*e*, 104*f* is illustrated as six frame segments, any number of frame segments are contemplated. The plurality of frame segments 104*a*, 104*b*, 104*c*, 104*d*, 104*e*, 104*f* can be titanium frame segments, although other materials are contemplated such as, but not limited to, platinum, tungsten, noble metals, or combinations of metals. It is further contemplated that each of the plurality of frame segments 104*a*, 104*b*, 104*c*, 104*d*, 104*e*, 104*f* can include at least one of the set of apertures 62.

At least one of the plurality of frame segments 104*a*, 104*b*, 104*c*, 104*d*, 104*e*, 104*f* conforms to the component 32. That is, at least one of the plurality of frame segments 104*a*, 104*b*, 104*c*, 104*d*, 104*e*, 104*f* includes a frame curve 106 or a frame protrusion 108 similar to a component curve 110 or a component protrusion 112.

The component curve 110 is a portion of the component 32 that is non-linear in at least one dimension. The component curve 110 can have boundaries 114, determined by rays extending from a center point 116 of the component 32 to either side of the component curve 110. The when the boundaries 114 are extended past the frame 74, the boundaries 114 then define the frame curve 106. The frame curve 106 is contoured such that the distance 118 between the component curve 110 and the frame curve 106 remains equal or generally constant, where term "generally constant" can be defined as having a percent difference of less than 5%. That is, when measured the distance 118 is measured between the frame 74 and the component 32 within the boundaries of 114, no two distance measurements will have a greater percent difference than 5%. Therefore, the at least one of the plurality of frame segments 104*c* that includes a contour or frame curve 106 can locate an entirety of the at least one of the plurality of frame segments 104*c* equidistant to the component 32. That is, the frame 74 or at least one of the plurality of frame segments 104*a*, 104*b*, 104*c*, 104*d*, 104*e*, 104*f* is shaped to maintain the equal distance 118 between the frame 74 or the plurality of frame segments 104*a*, 104*b*, 104*c*, 104*d*, 104*e*, 104*f* and at least a portion of the component 32. By way of non-liming example, the frame protrusion 108 can extend from a main frame portion 120 of the frame 74 at a frame protrusion angle 122. The frame protrusion angle 122 can be defined as the angle between a surface of the main frame portion 120 and a surface of the frame protrusion 108. Alternatively, the frame protrusion angle 122 can be determined by a centerline of the main frame portion 120 and a centerline of the frame protrusion 108 at the point of intersection of the main frame portion 120 and the frame protrusion 108.

A component protrusion angle 124, can be defined as the angle between a surface of a main component portion 126 and a surface of the component protrusion 112 that extends adjacent the frame protrusion 108. Alternatively, the component protrusion angle 124 can be determined by a centerline of the main component portion 126 and a centerline of the work component protrusion 112 at the point of intersection of the main component portion 126 and the component protrusion 112.

It is contemplated that difference between the frame protrusion angle 122 and corresponding component protrusion angle 124 is less than or equal to 10 degrees. That is, the frame protrusion angle 122 and corresponding component protrusion angle 124 are similar, where the frame protrusion 108 conforms to the component protrusion 112.

Optionally, a shield 130, can be coupled to or formed with at least one of the plurality of frame segments 104*e*. The shield 130 can comprise material that is electrically insulating to minimize or eliminate metallic deposition to one or more portions of the component 32. By way of non-limiting example, the shield 130 can be plastic, polypropylene, wax, polymer, silicon, polyurethane, high impact polystyrene (HIPS), poly carbonates (PCabs), or combinations therein. The shield can be formed with a portion of the frame 74 or coupled to the frame 74. It is further contemplated that the frame 74, the plurality of frame segments 104*a*, 104*b*, 104*c*, 104*d*, 104*e*, 104*f*, and/or the shield 130 can be additively manufactured.

At least one opening 132 can be defined by the frame 74 or at least one of the plurality of frame segments 104*a*, 104*b*, 104*c*, 104*d*, 104*e*, 104*f*. It is contemplated that each of the plurality of frame segments 104*a*, 104*b*, 104*c*, 104*d*, 104*e*, 104*f* can define at least one corresponding opening.

A mesh 136, which may comprise a web of wire or wire mesh can be coupled to the frame 74 or at least one of the plurality of frame segments 104*a*, 104*b*, 104*c*, 104*d*, 104*e*, 104*f*. The mesh 136 can span the at least one opening 132. The mesh 136 can be a titanium wire mesh, although other materials are contemplated such as, but not limited to, platinum, tungsten, noble metals, or combinations of metals.

A base structure 150 is defined by the frame 74 and the mesh 136. The base structure 150 defines an exterior 149, an interior 152, and a periphery 154. The interior 152 can include or define a fluid passage 156. The base structure 150 can be a multi-piece conformable housing for a conformable electroforming reservoir wherein the base structure 150 conforms to the component 32. That is, the base structure 150 can conform to or have a similar shapes and contours as the component 32.

Figure 4:
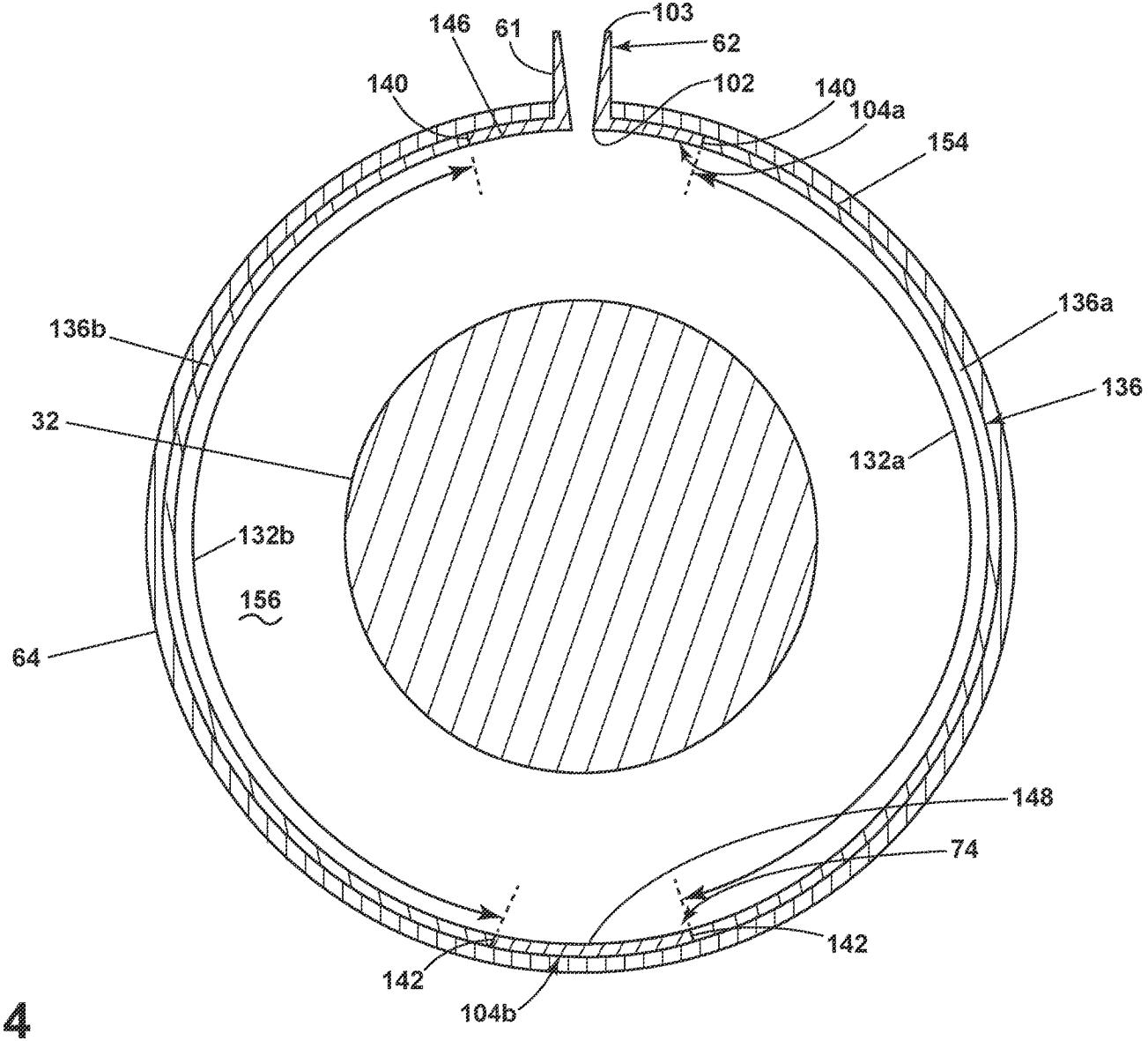
FIG. 4 is a schematic cross section of a portion of the second housing of FIG. 2 containing an electroformed component, at the line IV-IV.

FIG. 4 is an example of a schematic cross section, further illustrating the second housing 40. The aperture 62 is illustrated, by way of example, as having a narrowed portion 102. The narrowed portion 102 can be a nozzle or have a smaller cross section than an inlet portion 103. That is, the conduit 61 of the aperture 62 can have a changing inner diameter in the radial direction. The conduit 61 can be angled or interior cross section altered such that the narrowed portion 102 can provide a "throw angle" or impingement angle of the electrolytic fluid 44 against the component 32.

The mesh 136, as illustrated, can conform about the component 32. That is, the mesh 136 can be shaped or contoured to maintain an equal distance between the mesh 136 and the component 32 or at least a portion of the mesh 136 and the component 32.

The mesh 136 is illustrated, by way of example, as two pieces of mesh 136*a*, 136*b* that extend between a first frame segment 104*a* and a second frame segment 104*b* of the plurality of frame segments 104*a*, 104*b*, 104*c*, 104*d*, 104*e*, 104*f*. The two pieces of mesh 136*a*, 136*b* span a first opening 132A and a second opening 132B defined by the first frame segment 104*a* and the second frame segment 104*b*. The two pieces of mesh 136*a*, 136*b* couple to first side portions 140 of the first frame segment 104*a* and second side portions 142 of the second frame segment 104*b*. While illustrated as between portions of the first frame segment 104*a* and the second frame segment 104*b*, it is contemplated that the mesh 136 can extend over a radially outer surface 146 of the first frame segment 104*a* or the frame 74. That is, the mesh 136 can be located between the frame 74 and the cover 64.

Additionally, or alternatively, it is contemplated that the mesh 136 can contact a radially inward surface 148 of the second frame segment 104*b* or the frame 74. It is further contemplated that any number of discrete or coupled pieces of mesh can be used to define the mesh 136.

The cover 64, the electrically insulating sheet, or the polyethene/polypropylene sheet covers the periphery 154 of the base structure 150. The component 32 can be received or located in the fluid passage 156. The set of apertures 62 fluidly couple to the fluid passage 156 and extending radially outward from the base structure 150.

Figure 5:
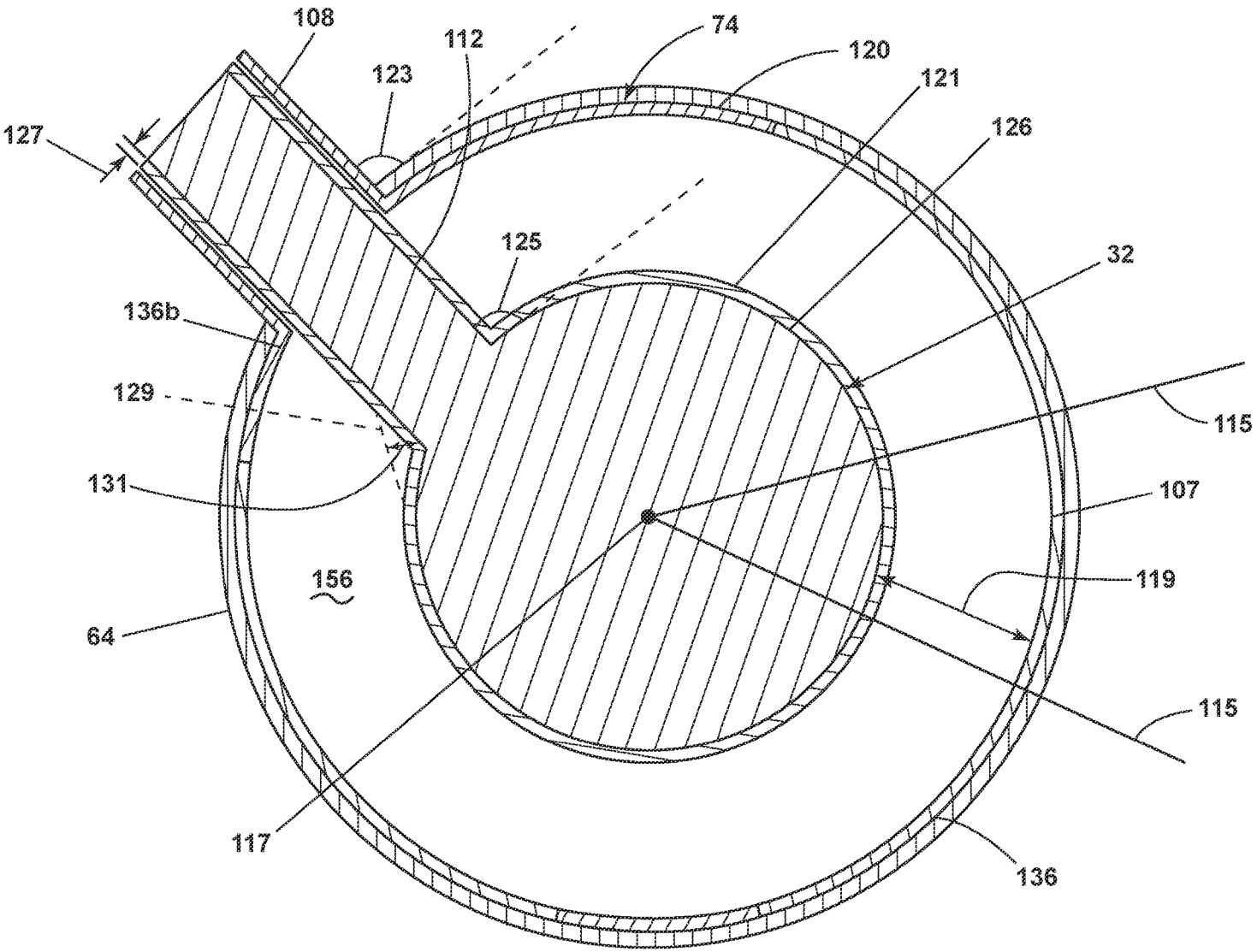
FIG. 5 is another schematic cross section of a portion of the second housing of FIG. 2 containing the electroformed component, at the line V-V.

FIG. 5 is another example of a schematic cross section, yet further illustrating the second housing 40 and the component 32 after the electroforming process is complete. That is, the component 32 has an electroformed metal layer 121. The electroformed metal layer 121 can have a first thickness 127, where the first thickness 127 is a uniform thickness. The term "uniform thickness," as used herein can mean that the thickness as measured in any two locations has a percent difference of less than 5%, wherein percent difference is calculated as one hundred times the difference between the first and second measurements, divided by the average of the first and second measurements.

Alternatively, the electroformed metal layer 121 can have portions that are "built up" or are intentionally more substantial or thicker. Portions of increased metal accumulation or thicker portions 129 can have a second thickness 131 greater than the at the first thickness 127.

The component 32 can include the component protrusion 112 and a component curve 111. The component curve 111 can be defined by boundaries 115 extending from a center point 117 of the component 32. The frame 74 and the mesh 136 can conform to the component 32. A mesh curve 107 can be defined by the boundaries 115. The mesh curve 107 is contoured such that the distance 119 between the component curve 111 and the mesh curve 107 remains generally constant or equal.

The frame protrusion 108 extends from the main frame portion 120 of the frame 74 at a frame protrusion angle 123. The frame protrusion angle 123 can be defined as the angle between a surface vector of the main frame portion 120 and a surface or surface vector of the frame protrusion 108.

A component protrusion angle 125, can be defined as the angle between a surface vector of the main component portion 126 and the surface or surface vector of the component protrusion 112 that extends adjacent the frame protrusion 108.

It is contemplated that difference between the frame protrusion angle 123 and corresponding component protrusion angle 125 is less than or equal to 10 degrees. That is, the frame protrusion angle 123 and corresponding component protrusion angle 125 are similar, where the frame protrusion 108 conforms to the component protrusion 112.

In operation, the controller 54 (FIG. 2) can activate the power source 38 to draw current from the first anode 36 coupled to the titanium basket 48 with coins 52, which causes metal ions to enter the electrolytic fluid 44. The electrolytic fluid 44 flows from the dissolution reservoir 42 of the first housing 34 via at least one outlet 96. The controller 54 can control the flow rate through the nozzle or valve 78 coupled to each of the set of apertures 62. That is, the controller 54 can be in communication with one or more valves 78, pumps (e.g. via the auxiliary component 92), or use gravity feed to control the flow of electrolytic fluid 44 from the first housing 34 via the at least one outlet 96 and into the multiple flow paths 66. The multiple flow paths 66 fluidly connect the at least one outlet 96 of the first housing 34 with the at least one inlet aperture 70 of the second housing 40, thereby fluidly connecting the dissolution reservoir 42 of the first housing 34 to the fluid passage 156 or the electroforming reservoir 60 of the second housing 40.

It is contemplated that the controller 54 can control multiple anodes and multiple dissolution reservoirs to provide the fluid passage 156 or electroforming reservoir 60 with the electrolytic fluid 44, wherein the electrolytic fluid entering the fluid passage 156 or electroforming reservoir 60 can have different densities.

The controller 54 can also communicate to the cathode 90 to provide a charge to the component 32. The at least one inlet aperture 70 can be configured to advance the electrolytic fluid 44 into the fluid passage 156 and toward the component 32 in a predetermined direction to form a metal layer on the component 32. It can be appreciated that each of the at least one inlet apertures 70 can also be formed with varying shapes or centerline angles to further direct or tailor the flow of electrolytic fluid 44 within the fluid passage 156 or around the component 32 in the electroforming reservoir 60.

An increased number of the set of apertures 62 located at or on one or more of the plurality of frame segments 104*a*, 104*b*, 104*c*, 104*d*, 104*e*, 104*f* can also be used to control the flow of the electrolytic fluid 44. Controlling the flow, density, or type of the electrolytic fluid 44 can result in a control of the thickness of metal deposition on the component 32.

The frame 74, when provided with a connection to the first anode 36 or the second anode 86 can further encourage metal deposition on the component 32. A current density at each of the plurality of frame segments 104*a*, 104*b*, 104*c*, 104*d*, 104*e*, 104*f* can be maintained or varied the controller 54 through changing or maintaining the electric potential across the first anode 36 or the second anode 86. The controller 54 can activate the first anode 36 or the second anode 86 based on the component 32 geometry to provide a predetermined current density. The geometry of the plurality of frame segments 104*a*, 104*b*, 104*c*, 104*d*, 104*e*, 104*f* can include contours that locate an entirety of the at least one of the plurality of frame segments 104*a*, 104*b*, 104*c*, 104*d*, 104*e*, 104*f* equidistant to the component 32.

The frame 74 can include the shield 130, wherein portions of the component 32 adjacent or corresponding to the shield 130 of the frame 74 do not experience metal deposition. That is, the shield 130 can electrically insolate at least a portion of the frame 74, minimizing or eliminating the metal deposition to one or more portions of the component 32.

The controller 54 can operate the recirculation circuit 94, so that the electrolytic fluid 44 can exit the second housing 40 via the at least one outlet aperture 72 and recirculate back to the dissolution reservoir 42 of the first housing 34. The electrolytic fluid 44 can then increase in metal ion density before again exiting the first housing 34. This recirculation circuit 94 provides the fluid passage 156 or the electroforming reservoir 60 with a constant source of electrolytic fluid 44.

By maintaining a uniform current density and proper flow of the electrolytic fluid 44, the metal deposition on the component 32 can be the first thickness 127 or uniform thickness. Additionally, or alternatively, regions or portions of the component 32 can be built up to have the second thickness 131. The increase in thickness of the metal deposition can be controlled at the controller 54 by changing the current density via the first anode 36 to the auxiliary anode 86 and controlling the type and flow of electrolytic fluid 44 to specific locations of the second housing 40.

Once the component 32 has completed the electroforming process, the controller 54 can remove the charges provided by the first anode 36, the second anode 86, or the cathode 90 and remove the electrolytic fluid 44 from the fluid passage 156 or the electroforming reservoir 60. The ability to cease charge and remove fluid in a timely manner can help reduce or eliminate boundary effects. Boundary effects can result from charge or fluid remaining in contact with the component 32 past completion of the application of the desired amount of metal to the component 32.

Figure 6:
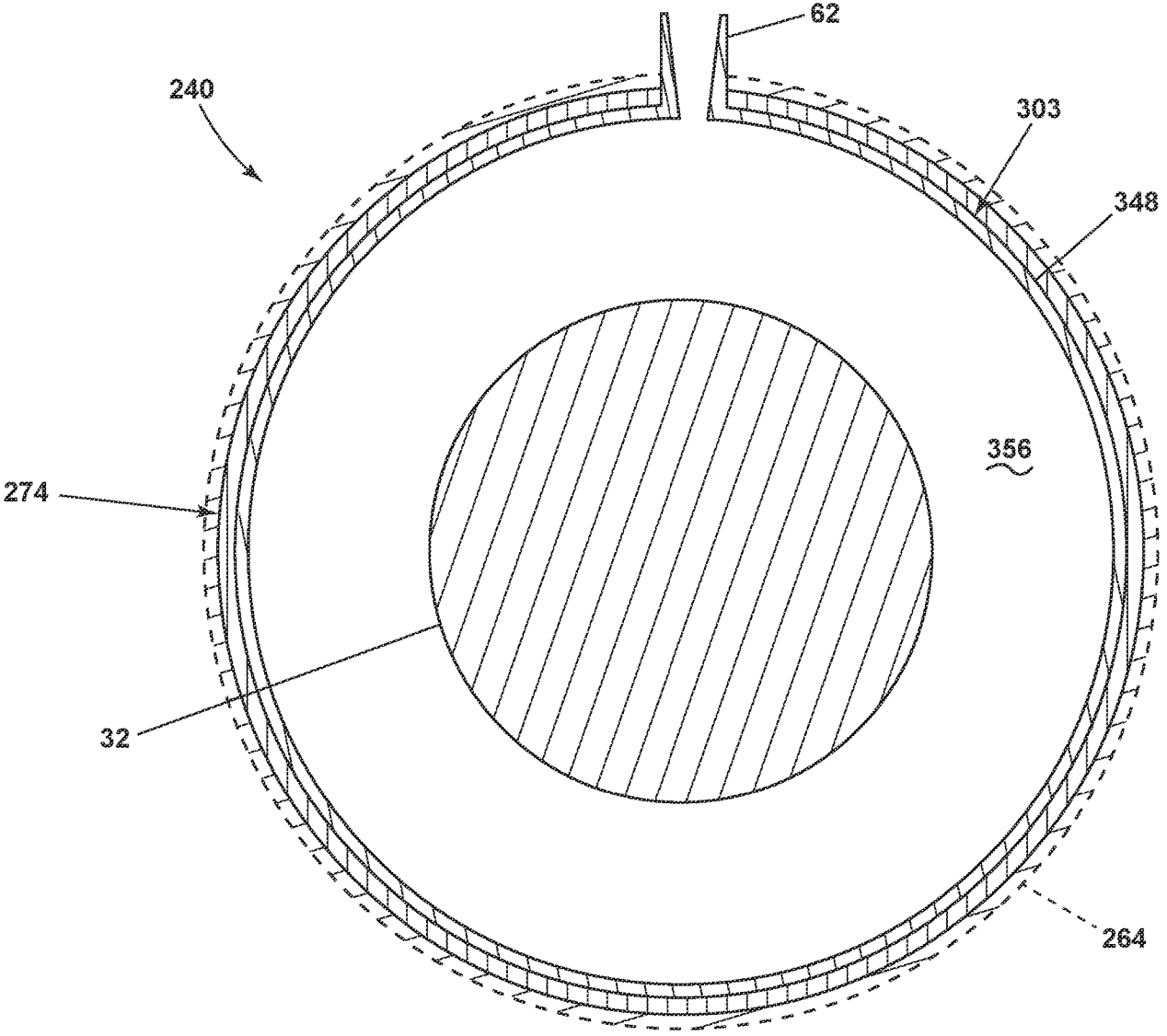
FIG. 6 is another example of the schematic cross section of FIG. 4 according to various aspects of the disclosure.

FIG. 6 is another example of a schematic cross section of a second housing 240. The second housing 240 is similar to the second housing 40, therefore, like parts will be identified with like numerals increased by 200, with it being understood that the description of the like parts of the second housing 40 applies to the second housing 240, unless otherwise noted.

The second housing 240 includes a frame 274. The frame 274 can be a solid frame. Alternatively, the frame 274 can include one or more openings (not shown). The frame 274 can be formed, cast, or printed and can include plastic, polypropylene, wax, polymer, silicon, polyurethane, high impact polystyrene (HIPS), poly carbonates (PCabs), or combinations therein. While illustrated as a uniform piece, the frame 274 can be defined by the assembly of a plurality of frame segments.

The frame 274 can include a coating 303 on one or more portions of a radially inward surface 348. The coating 303 can be titanium, although other materials are contemplated such as, but not limited to, platinum, tungsten, noble metals, or combinations of metals. The coating 303 can be applied such that the coating 303 or the frame 274 is an equal distance from the component 32. The coating 303 is illustrated, by way of example, as coating or covering the entire frame 274. It is contemplated that the coating 303 can be one or more sections of coating that cover different or separate portions of the frame 274. It is further contemplated that the first anode 36 or the second anode 86 can be connected to different portions of the coating 303 or frame 274.

The coating 303 is illustrated, by way of example, as having a uniform thickness. It is contemplated that the coating 303 can have varying thickness. It is further contemplated that the thickness of the coating 303 can depend on the shape or contour of the component 32.

The set of apertures 62 are provided with the frame 274 and extending radially outward from the frame 274. The set of apertures 62 fluidly couple to a fluid passage 356 defined by the coating 303 or the frame 274.

Optionally, the frame 274 can include a cover 264, wherein the cover 264 can be an electrically insulating sheet, such as, but not limited to, a polyethene or polypropylene sheet.

Figure 7:
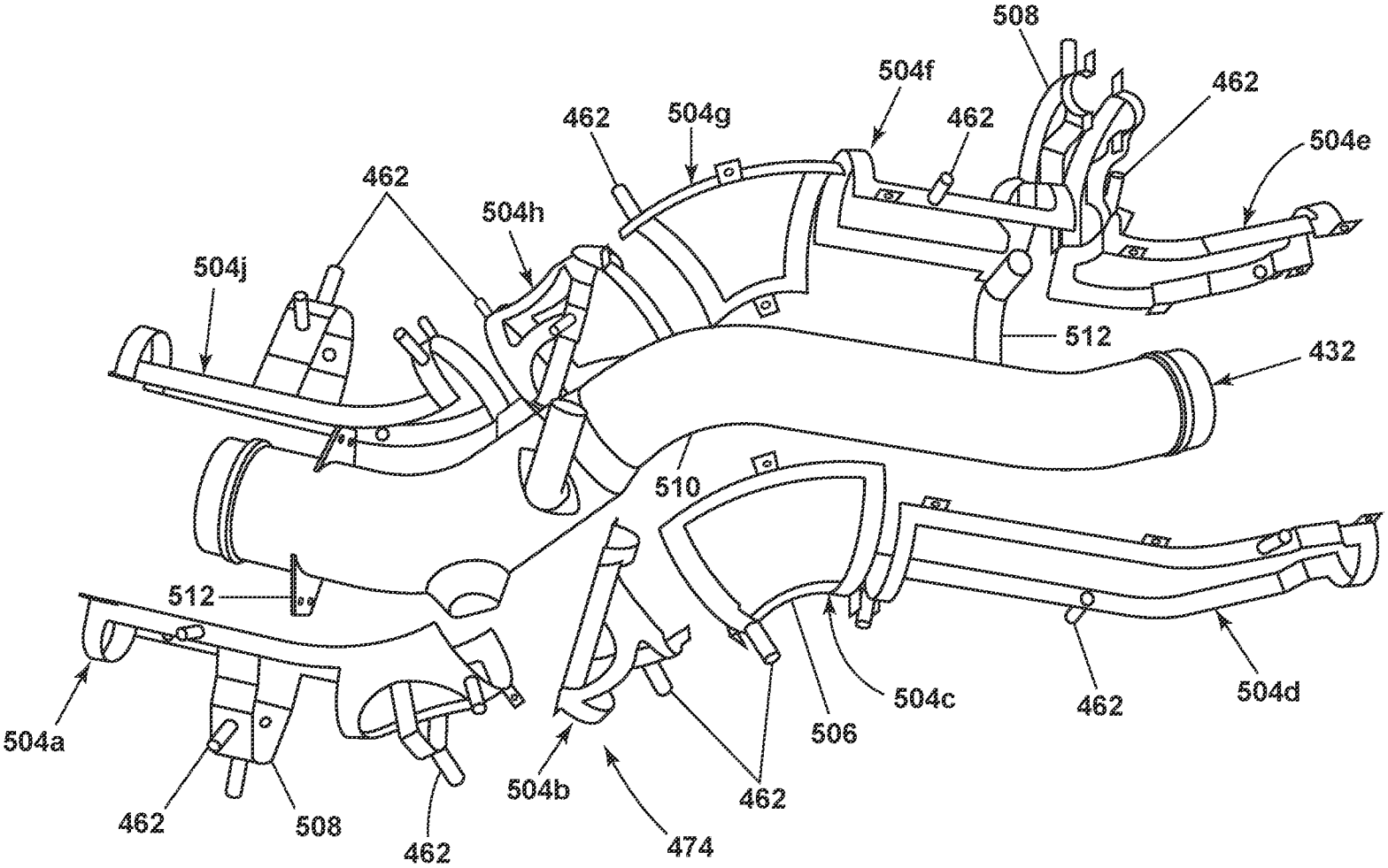
FIG. 7 is an exploded view of another example of a frame for a second housing that can be utilized in the system of FIG. 2 according to various aspects of the disclosure.

FIG. 7 is an exploded view of another example of a frame 474 that can be part of a multi-piece conformable housing that defines a conformable electroforming reservoir for electroforming a workpiece or component 432. The frame 474 is similar to the frame 74, therefore, like parts will be identified with like numerals increased by 400, with it being understood that the description of the like parts of the frame 74 applies to the frame 474, unless otherwise noted.

A plurality of frame segments 504*a*, 504*b*, 504*c*, 504*d*, 504*e*, 504*f*, 504*g*, 504*h*, 504*j* can be coupled together to define the frame 474. A set of apertures 462 are provided with the frame 474, where each of the plurality of frame segments 504*a*, 504*b*, 504*c*, 504*d*, 504*e*, 504*f*, 504*g*, 504*h*, 504*j* includes at least one of the set of apertures 462.

The frame 474 can define a second housing 440 (FIG. 8), where the second housing 440 is the multi-piece conformable housing that can define the conformable electroforming reservoir. That is, the frame 474 can be part of a multi-piece conformable housing 440 that conforms to the component 432, where the geometry of component 432 determines the geometry of each of the plurality of frame segments 504*a*, 504*b*, 504*c*, 504*d*, 504*e*, 504*f*, 504*g*, 504*h*, 504*j*.

At least one of the plurality of frame segments 504*a*, 504*b*, 504*c*, 504*d*, 504*e*, 504*f*, 504*g*, 504*h*, 504*j* includes a frame curve 506 similar to a component curve 510. Additionally, or alternatively, at least one of the plurality of frame segments 504*a*, 504*b*, 504*c*, 504*d*, 504*e*, 504*f*, 504*g*, 504*h*, 504*j* includes a frame protrusion 508 similar to a component protrusion 512. That is, the geometry of the at least one frame segment 504*a*, 504*b*, 504*c*, 504*d*, 504*e*, 504*f*, 504*g*, 504*h*, 504*j* includes a contour or protrusion that locates an entirety of the at least one of the plurality of frame segments 504*a*, 504*b*, 504*c*, 504*d*, 504*e*, 504*f*, 504*g*, 504*h*, 504*j* equidistant to the component 432.

Figure 8:
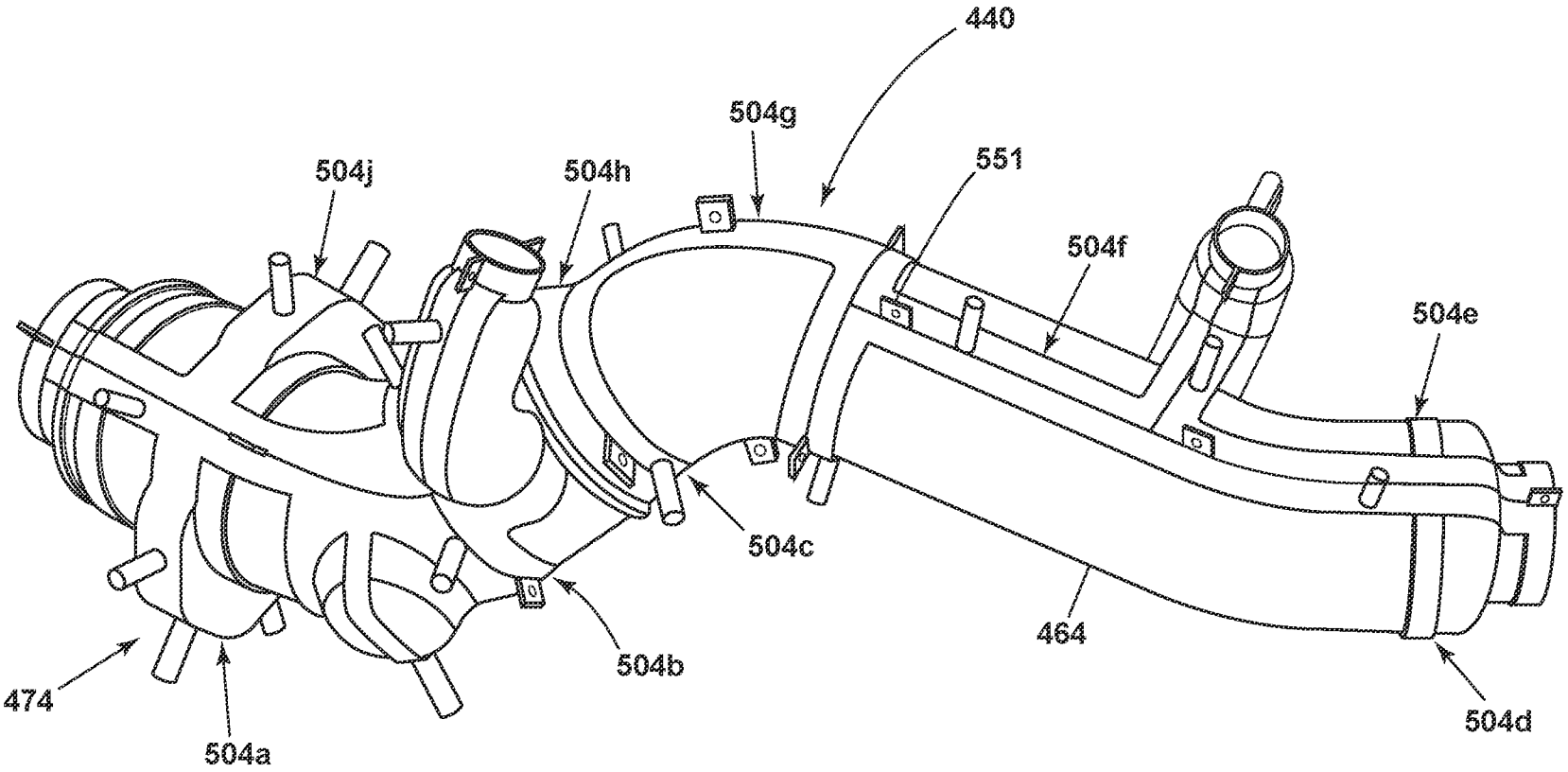
FIG. 8 is a perspective view of the second housing of FIG. 7.

FIG. 8 illustrates the second housing or multi-piece conformable housing 440 that can define the conformable electroforming reservoir. The plurality of frame segments 504*a*, 504*b*, 504*c*, 504*d*, 504*e*, 504*f*, 504*g*, 504*h*, 504*j* are illustrated as coupled together to define the frame 474. A cover 464 has been placed over the mesh (not shown). The cover 464 and the mesh are fixed to the frame 474. The cover 464 and mesh can be contained by the frame 474 or couple to it so that the frame 474 and the mesh are equidistant from the component 432. Alternatively, the cover 464 can be coupled to a frame interior or a frame exterior without the mesh.

The multi-piece conformable housing 440 can include multiple curves or complicated geometries to define the conformable electroforming reservoir capable of conforming to the complex geometries of the component 432.

A plurality of exterior brackets 551 can be used to couple the plurality of frame segments 504*a*, 504*b*, 504*c*, 504*d*, 504*e*, 504*f*, 504*g*, 504*h*, 504*j* together to define the frame 474. The plurality of exterior brackets 551 can be fixed together using any one or more of pins, screws, bolts, spot weld, clamps, clasps, or other known fasteners. One or more of the plurality of frame segments 504*a*, 504*b*, 504*c*, 504*d*, 504*e*, 504*f*, 504*g*, 504*h*, 504*j* can be selectively attached. That is, one or more of the plurality of frame segments 504*a*, 504*b*, 504*c*, 504*d*, 504*e*, 504*f*, 504*g*, 504*h*, 504*j* can be removable from the remainder of the plurality of frame segments 504*a*, 504*b*, 504*c*, 504*d*, 504*e*, 504*f*, 504*g*, 504*h*, 504*j*.

Figure 9:
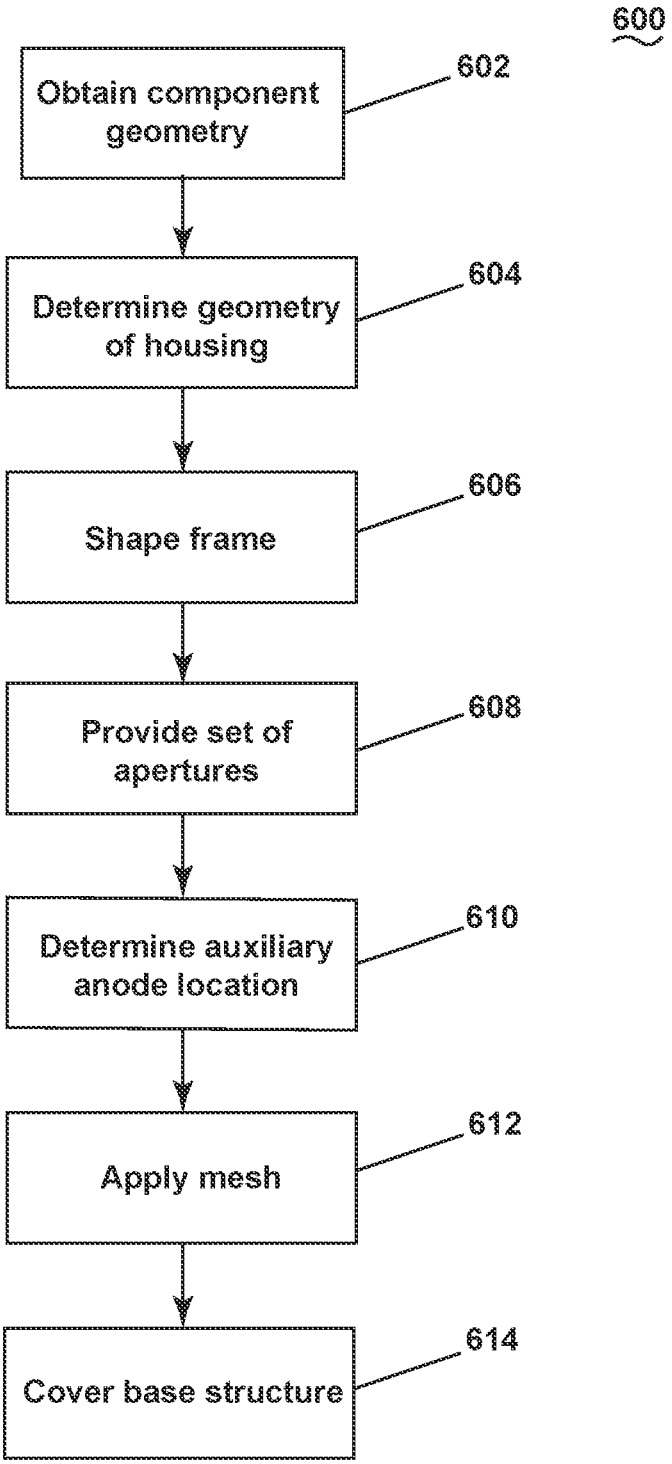
FIG. 9 is a flowchart diagram illustrating a method of electroforming a component according to various aspects of the disclosure.

FIG. 9 illustrates a method 600 of forming the conformable electroforming reservoir that can be defined by the second housing or the multi-piece conformable housing 40, 240, 440. The method 600 includes obtaining 602 a component geometry. The component geometry can be the geometry of the component 32, 432. The geometry of the component 32, 432 can be obtained from one or more known computer assisted or advance design programs. The geometry of the component 32, 432 can also be obtained by optical scanning of the component 32, 432. Additionally, or alternately, the geometry of the component 32, 432 can be obtained by direct measurement or any other means known in the art.

A geometry of the second housing or the multi-piece conformable housing 40, 240, 440 can be determined 604 based on the component 32, 432 geometry. That is, any component curve or workpiece protrusion 110, 111, 112 of the component 32, 432 will result in corresponding frame/mesh curves or frame protrusions 106, 107, 108 in the multi-piece conformable housing 40, 240, 440; either represented in the mesh 136 or the frame 74, 274, 474. Additionally, or alternatively, the determination of the geometry of the multi-piece conformable housing 40, 240, 440 can be based on the component geometry in order to maintain equal distance between the component 32, 432 and the frame 74, 274, 474 or the one or more frame segment 104*a*, 104*b*, 104*c*, 104*d*, 104*e*, 104*f*, 504*a*, 504*b*, 504*c*, 504*d*, 504*e*, 504*f*, 504*g*, 504*h*, 504*j*.

The frame 74, 274, 474 can be shaped 606 based on the determining the geometry of the multi-piece conformable housing 40, 240, 440. The frame 74, 274, 474 can be formed from assembling the plurality of frame segments 104*a*, 104*b*, 104*c*, 104*d*, 104*e*, 104*f*, 504*a*, 504*b*, 504*c*, 504*d*, 504*e*, 504*f*, 504*g*, 504*h*, 504*j* wherein the plurality of frame segments 104*a*, 104*b*, 104*c*, 104*d*, 104*e*, 104*f*, 504*a*, 504*b*, 504*c*, 504*d*, 504*e*, 504*f*, 504*g*, 504*h*, 504*j* define the frame 74, 274, 474. Optionally, the at least one of the plurality of frame segments 104*e* includes the shield 130.

The set of apertures 62, 462 can be proved 608 with the frame 74, 274, 474. It is contemplated that each of the plurality of frame segments 104*a*, 104*b*, 104*c*, 104*d*, 104*e*, 104*f*, 504*a*, 504*b*, 504*c*, 504*d*, 504*e*, 504*f*, 504*g*, 504*h*, 504*j* can include at least one aperture from the set of apertures 62, 462. The set of apertures 62, 462 can be angled or include one or more of the nozzle or valve 78 to control or direct the flow of electrolytic fluid 44 into or out of the fluid passage 156.

The location of the second anode or the at least one auxiliary anode 86 can be determined 610 based on the obtaining 602 of the component geometry. The at least one auxiliary anode 86 is provided with a portion of the frame 74, 274, 474. The activation of the first anode 36 or the auxiliary anode 86 by the controller 54 allows for control of current density at each of the plurality of frame segments 104*a*, 104*b*, 104*c*, 104*d*, 104*e*, 104*f*, 504*a*, 504*b*, 504*c*, 504*d*, 504*e*, 504*f*, 504*g*, 504*h*, 504*j*.

The titanium mesh or mesh 136 can be applied 612 to the frame 74, 474 to form the base structure 150. The exterior 149 of the base structure 150 can then be covered 614 with the polyethene or polypropylene sheet or cover 64, 464. The set of apertures 62, 462 provided at the frame 74, 274, 474 can extend radially beyond the polyethene/polypropylene sheet or cover 64, 464.

Aspects of the present disclosure provide for a variety of benefits including the ability to control the thickness and the material composition of the metal disposition on a component or workpiece. The variation in geometry of the base structure and the ability to couple to one or more auxiliary anodes to the frame allows for control over current densities. With control over the current densities throughout different portions of the base structure, uniform current zones can be achieved; even when the component or workpiece includes complex geometries such as curves or protrusions.

That is, the thickness and composition of the metal bonding to the component can be controlled by one or more auxiliary anodes coupled to one or more portions of the frame of the base structure. By varying the electric potential across auxiliary anodes, the thickness and elemental composition can be controlled. That is, how much and what metallic ions in the electrolyte solution or electrolytic fluid bond to the component can be controlled through the use of auxiliary anodes.

Additionally, the conforming electroforming reservoir defined by the base structure minimizes the size of the electroforming reservoir and therefore reduces the amount of electrolyte solution or electrolytic fluid needed. Further, the dissolution reservoir can replenish the metallic ions in the electrolytic fluid as the electrolytic fluid flows back and forth from dissolution reservoir to the conforming electroforming reservoir.

Another advantage is that the set of apertures in the electroforming reservoir can be utilized to provide a variety of "throw angles" or impingement angles of the electrolyte solution or electrolytic fluid on the component. Such tailoring of throw angles can improve the coverage of electrolyte solution or electrolytic fluid over hard to reach areas of the component, as well as provide for custom metal layer thickness at various regions of the electroformed component. It can also be appreciated that tailoring an impingement angle in combination with a flow rate or speed onto the component can further provide for customized metal layer thicknesses at various regions of the electroformed component.

Additionally, the set of apertures, specifically the inlet apertures, can be fluidly coupled to a one or more dissolution reservoirs. The set of apertures can then provide different densities of electrolyte solution or electrolytic fluid to the flow passage. That is, the set of apertures can provide electrolyte solution or electrolytic fluid with different concentrations or electrolyte solution or electrolytic fluid with ions of differing metals.

Yet another advantage realized by aspects of the disclosure is the reduction or elimination of boundary layer effects. The control over the flow of electrolyte solution or electrolytic fluid via the nozzles, valves, pumps, or auxiliary components and the control over the current density via the geometry and auxiliary anodes ensures that only fluid intended to be in contact with the component, reaches the component.

Still yet another advantage is that customizable, reusable, conforming electroforming reservoir can be configured to accommodate a wide variety of shapes and sizes for different components or workpieces. For example, a component with a complex geometry in which controlling the thickness so that the thickness is uniform or varying depending on the need of the component, can be formed in using the conforming electroforming reservoir that conforms to the geometry of the component.

Another advantage of aspects of the disclosure relate to locating the sacrificial anode or coins in the dissolution reservoir separate from the electroforming housing that holds the electroformed component. The separate housings and control of the recirculation of the electrolytic fluid between them can greatly reduce the chance of unwanted particulate matter. Therefore, undesired irregularities in the electroformed component are reduced.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are provided by the subject matter of the following clauses:

A system for electroforming a component, comprising a first housing forming a dissolution reservoir containing an electrolytic fluid, a first anode coupled to or at least partially located within the first housing, a power source electrically coupled to the first anode, and a second housing adapted to receive a component, located exterior of the first housing, the second housing comprising a frame, wherein the frame includes at least one opening, a mesh coupled to the frame, to define a base structure having an interior and a periphery, wherein the mesh spans the at least one opening, an electrically insulating sheet covering at least a portion of the interior of the base structure and wherein the electrically insulating sheet defines a fluid passage, the component located in the fluid passage, and a set of apertures provided with the frame, the set of apertures fluidly coupled with the fluid passage and extending radially outward from the base structure.

The system of any of the preceding clauses, further comprising a second anode provided with a portion of the frame.

The system of any of the preceding clauses, wherein the frame includes a plurality of frame segments that are coupled together to define the frame.

The system of any of the preceding clauses, wherein at least one of the plurality of frame segments conforms to the component, wherein the at least one of the plurality of frame segments includes a frame curve or frame protrusion similar to a component curve or component protrusion.

The system of any of the preceding clauses, wherein each of the plurality of frame segments includes at least one of the set of apertures.

The system of any of the preceding clauses, wherein at least one of the plurality of frame segments includes a contour that locates an entirety of the at least one of the plurality of frame segments equidistant to the component.

The system of any of the preceding clauses, wherein at least one of the plurality of frame segments includes a shield coupled to or formed with the at least one of the plurality of frame segments.

The system of any of the preceding clauses, wherein the plurality of frame segments are titanium frame segments.

The system of any of the preceding clauses, further comprising a controller, wherein a current density at each of the plurality of frame segments is determined by the controller.

The system of any of the preceding clauses, wherein the set of apertures fluidly couple the fluid passage of the second housing and the dissolution reservoir of the first housing via multiple flow paths.

The system of any of the preceding clauses, wherein the set of apertures includes at least one inlet aperture and at least one outlet aperture, wherein the at least one inlet aperture couples to or includes a valve or nozzle to control flow of electrolytic fluid to different portions of the second housing.

The system of any of the preceding clauses, further comprising a controller that controls flow rate through the valve or nozzle coupled to each of the set of apertures.

The system of any of the preceding clauses, wherein the second housing is a conformable electroforming reservoir, wherein at least a portion of the frame or at least a portion of the mesh conforms about the component.

The system of any of the preceding clauses, further comprising a cathode located exterior of the second housing and coupled to the component located in the fluid passage.

The system of any of the preceding clauses, wherein the electrically insulating sheet includes polyethene or polypropylene.

A method of forming a conformable electroforming reservoir, the method comprising obtaining a component geometry, determining a geometry of a multi-piece conformable housing based on the component geometry, shaping a frame based on the determining the geometry of the multi-piece conformable housing, providing a set of apertures with the frame, determining at least one auxiliary anode location based on the component geometry, wherein the at least one auxiliary anode is provided with a portion of the frame, applying a titanium mesh to the frame to form a base structure, and covering an exterior of the base structure with a polyethene/polypropylene sheet, wherein the set of apertures extend radially beyond the polyethene/polypropylene sheet.

The method of any of the preceding clauses, wherein the shaping of the frame further comprises assembling the frame as a plurality of frame segments wherein the plurality of frame segments define the frame.

The method of any of the preceding clauses, wherein the providing the set of apertures includes at least one aperture formed with or coupled to each of the plurality of frame segments.

The method of any of the preceding clauses, wherein at least one of the plurality of frame segments includes a shield.

The method of any of the preceding clauses, wherein the determining of the geometry of the multi-piece conformable housing based on the component geometry maintains an equal distance between the component and the frame.

What is claimed is:

1. A system for electroforming a component, comprising:
- a first housing forming a dissolution reservoir, the dissolution reservoir containing an electrolytic fluid;
- a first anode coupled to or at least partially located within the first housing; and
- a second housing located exterior of the first housing, the second housing adapted to receive a component, the second housing comprising:
  - a frame having an opening;
  - a mesh spaced from the component and coupled to the frame to define a base structure, wherein the mesh spans the opening; and
  - an electrically insulating sheet covering at least a portion of the base structure and wherein the electrically insulating sheet defines a fluid passage, the component to be located in the fluid passage.

2. The system of claim 1, wherein the fluid passage of the second housing is fluidly coupled to the dissolution reservoir of the first housing by multiple flow paths.

3. The system of claim 2, further comprising a connecting channel coupling at least two of the multiple flow paths.

4. The system of claim 2, further comprising a controller that controls flow rate through at least one of the multiple flow paths via a valve or nozzle.

5. The system of claim 2, further comprising auxiliary components coupled to one or more of the multiple flow paths.

6. The system of claim 5, wherein the auxiliary components include one or more of a pump, a switch, a fluid flow sensor, a temperature sensor, a mass density sensor, a viscosity sensor, an optical sensor, or a level sensor.

7. The system of claim 1, wherein the second housing is a multi-piece conformable housing that conforms to or has similar shapes and contours as the component.

8. The system of claim 1, further comprising a power source electrically coupled to the first anode; and a second anode coupled to the second housing and electrically coupled to the power source.

9. The system of claim 1, wherein the frame is defined by a plurality of frame segments.

10. The system of claim 9, wherein at least one segment of the plurality of frame segments includes a frame curve or frame protrusion similar to a component curve or component protrusion.

11. The system of claim 9, further comprising a shield coupled to or formed with the at least one of the plurality of frame segments.

12. The system of claim 9, further comprising a plurality of exterior brackets extending from the plurality of frame segments, wherein at least two brackets of the plurality of exterior brackets couple at least two segments of the plurality of frame segments.

13. The system of claim 1, further comprising a cathode located exterior of the second housing and coupled to the component located in the fluid passage.

14. The system of claim 1, wherein the electrically insulating sheet includes polyethene or polypropylene.

15. The system of claim 1, wherein at least a portion of an exterior of the base structure couples to a cover.

16. The system of claim 1, wherein the frame comprises at least a first frame defining a first opening and a second frame defining a second opening, and wherein the mesh includes at least two pieces of mesh, wherein a first piece of mesh spans the first opening and a second piece of mesh spans the second opening.

* * * * *